US008522554B2

(12) United States Patent
Intile et al.

(10) Patent No.: US 8,522,554 B2
(45) Date of Patent: Sep. 3, 2013

(54) FUEL NOZZLE FOR A TURBINE ENGINE WITH A PASSIVE PURGE AIR PASSAGEWAY

(75) Inventors: John Intile, Simpsonville, SC (US); Predrag Popovic, Greenville, SC (US); Lucas John Stoia, Greenville, SC (US)

(73) Assignee: General Electric Company, Schenectady, NY (US)

( * ) Notice: Subject to any disclaimer, the term of this patent is extended or adjusted under 35 U.S.C. 154(b) by 705 days.

(21) Appl. No.: 12/652,244

(22) Filed: Jan. 5, 2010

(65) Prior Publication Data

US 2011/0162373 A1 Jul. 7, 2011

(51) Int. Cl.
*F02C 1/00* (2006.01)
*F02G 3/00* (2006.01)

(52) U.S. Cl.
USPC ..... 60/740; 60/742; 60/746

(58) Field of Classification Search
USPC ..... 60/740, 748, 742, 746, 776, 737, 60/758, 39.094, 39.091; 239/399
See application file for complete search history.

(56) References Cited

U.S. PATENT DOCUMENTS

| | | | | |
|---|---|---|---|---|
| 4,041,695 | A | 8/1977 | Harper et al. | |
| 4,860,533 | A * | 8/1989 | Joshi | 60/776 |
| 5,277,023 | A * | 1/1994 | Bradley et al. | 60/39.094 |
| 6,145,294 | A | 11/2000 | Traver et al. | |
| 6,609,380 | B2 * | 8/2003 | Mick et al. | 60/776 |
| 7,104,070 | B2 | 9/2006 | Iasillo et al. | |
| 7,430,851 | B2 * | 10/2008 | Patwari | 60/39.094 |
| 7,828,546 | B2 * | 11/2010 | Wiedenhoefer et al. | 431/346 |
| 2004/0045296 | A1 * | 3/2004 | Wiebe et al. | 60/737 |
| 2006/0080966 | A1 * | 4/2006 | Widener | 60/775 |
| 2006/0283193 | A1 * | 12/2006 | Nilsson | 60/776 |

* cited by examiner

*Primary Examiner* — Phutthiwat Wongwian
*Assistant Examiner* — Craig Kim
(74) *Attorney, Agent, or Firm* — Nixon & Vanderhye P.C.

(57) ABSTRACT

A secondary fuel nozzle for a turbine includes a passive purge air passageway which provides purge air to the secondary nozzle at all times that the nozzle is in operation. The passive purge air passageway draws in air from a location adjacent an upstream end of the nozzle. Because of a pressure differential between air located at the downstream end of the nozzle and air located at the upstream end of the nozzle, purge air will run through the passive purge air passageway at all times the nozzle is in operation. There is no need for a supply of compressed purge air.

11 Claims, 4 Drawing Sheets

FUEL NOZZLE FOR A TURBINE ENGINE WITH A PASSIVE PURGE AIR PASSAGEWAY

BACKGROUND OF THE INVENTION

Turbine engines that are used in the electric power generation industry typically include a plurality of combustors which are arranged concentrically around an input to the turbine section. A typical combustor assembly is shown in FIG. 1. The combustor assembly includes both primary and secondary fuel nozzles.

The primary and secondary fuel nozzles inject fuel into a flow of compressed air received from the compressor side of the turbine. The fuel is mixed with the air, and the fuel-air mixture is then ignited downstream from the fuel injectors in one or more combustion zones. Ideally, the combustion takes place at a location that is located downstream from the distal ends of the fuel nozzles so that the nozzles themselves are not subjected to extremely high temperatures. In addition, it is common for fuel nozzles to include purge air passageways which conduct a flow of the compressed air that is designed to cool the nozzles.

During some turbine operational conditions, the purge air passageways of the fuel nozzle are temporarily prevented from conducting a flow of cooling air. In those instances, portions of the fuel nozzles adjacent the combustion zones can be subjected to extremely high temperatures that can damage the fuel nozzles. Typically, the downstream ends of the nozzles are subjected to the highest temperatures, and are therefore most likely to be damaged.

BRIEF DESCRIPTION OF THE INVENTION

In one aspect, the invention may be embodied in a fuel nozzle for a turbine engine that includes an elongated housing having a central longitudinal axis, at least one fuel delivery passageway that extends down at least a portion of the housing, and an active purge air passageway that extends down the housing and that delivers purge air to at least one active purge air discharge opening that is located at the discharge end of the nozzle. The fuel nozzle also includes a passive purge air passageway having an inlet that admits air from a position outside the nozzle and adjacent an upstream end of the housing, and having an outlet that is located at the discharge end of the nozzle.

In another aspect, the invention may be embodied in a fuel nozzle for a turbine engine that includes an elongated housing having a central longitudinal axis, a fuel delivery passageway that extends along at least a portion of the housing, and an active purge air passageway that extends along the housing and that delivers purge air to at least one active purge air discharge opening that is located at a downstream end of the nozzle. The fuel nozzle also includes a passive purge air passageway having an inlet that admits air from a position outside the nozzle and adjacent an upstream end of the housing, and having an outlet that is located at the downstream end of the nozzle, wherein when the fuel nozzle is in use in an operational turbine engine, a pressure differential between air outside the nozzle and adjacent the upstream end of the housing and air located at the outlet of the passive purge air passageway causes purge air to flow along the passive purge air passageway from the inlet to the outlet.

DETAILED DESCRIPTION OF THE INVENTION

Figure 1:
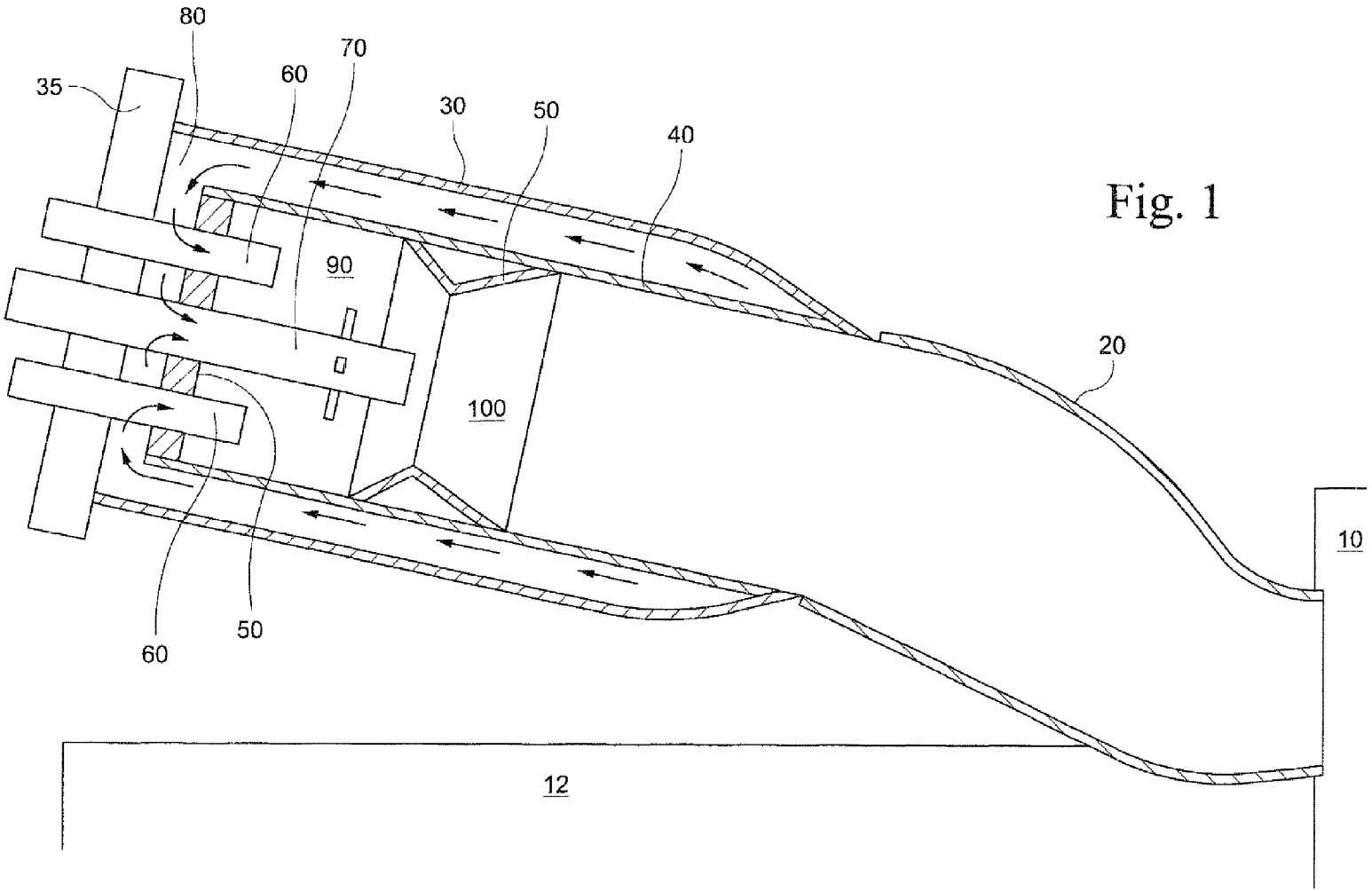
FIG. 1 is a cross-sectional view illustrating elements of a typical combustor of a turbine engine.

A typical combustor assembly for a turbine engine is illustrated in FIG. 1. As shown therein, the combustor includes a transition duct 20 which routes combustion gases into the turbine section. The transition duct 20 is attached to a combustor liner 40. A flow sleeve 30 surrounds the exterior of the combustor liner 40.

Compressed air from the compressor section of the turbine is routed into the annular space between the combustor liner 40 and the flow sleeve 30. The arrows in FIG. 1 illustrate the direction of movement of the compressed air. As shown in FIG. 1, the compressed air moves along the annular space between the combustor liner and the flow sleeve 30 to the upper end of the combustor. The compressed air then turns and enters the space inside the combustor liner 40.

A plurality of fuel nozzles 60, 70 are located at the upstream end of the combustor. Multiple primary fuel nozzles 60 are mounted in an annular ring around a combustor cap 50. In addition, at least one secondary fuel nozzle 70 is located in the center of the combustor. As shown in FIG. 1, the secondary fuel nozzle 70 typically extends a greater distance down the length of the combustor.

Combustion within the combustor typically takes place in two different locations. There is a primary combustion zone 90 located at the far upstream end of the combustor and adjacent the discharge ends of the primary fuel nozzles 60. In addition, there is a secondary combustion zone 100 located further down the length of the combustor and adjacent a discharge end of the secondary fuel nozzle 70. In some combustors, a venturi is formed between the primary combustion zone 90 and the secondary combustion zone 100 by angled walls 55. The angled walls 55 neck in to reduce an interior diameter of the combustor. The venturi formed by the angled walls 55 increases the speed of the air and fuel passing through this section of the combustor immediately before the air-fuel mixture enters the secondary combustion zone 100.

During an initial start up procedure, fuel is delivered into the combustor through both the primary fuel nozzles 60 and the secondary fuel nozzle 70. The air fuel mixture is ignited in both the primary combustion zone 90 and the secondary combustion zone 100. The operating speed of the turbine is increased and a load, typically in the form of an electrical power generator, is placed on the turbine.

To achieve optimum emissions, it is desirable for combustion to take place only in the secondary combustion zone 100. Thus, although it is necessary to initially have combustion occurring in both the primary combustion zone 90 and the secondary combustion zone 100, at some point during the start up procedure it is necessary to eliminate combustion in the primary combustion zone 90.

In order to eliminate combustion in the primary combustion zone 90, it is necessary to temporarily cut off fuel to the primary fuel nozzles 60. During this transition time period, fuel is still delivered into the secondary combustion zone 100 through the secondary fuel nozzle 70. Once fuel has been cut to the primary fuel nozzles 60 for a period of time, combustion in the primary combustion zone 90 will cease, and combustion will only continue to take place in the secondary combustion zone 100.

Because a load is placed on the turbine, and to ensure that the turbine maintains this load, one cannot simply cut fuel to the primary fuel nozzles. Instead, it is necessary for approximately the same amount of fuel to be continuously delivered into the combustor during the transition time period. Thus, in a typical transition sequence, when the fuel is cut to the primary fuel nozzles 60, the same amount of fuel that was being delivered through the primary fuel nozzles 60 is instead delivered through passages of the secondary fuel nozzle 70. This means that the secondary fuel nozzle 70 must deliver all of the fuel which was previously being delivered into the combustor through both the primary fuel nozzles 60 and the secondary fuel nozzle 70.

Once combustion is no longer occurring in the primary combustion zone 90, fuel can again be delivered through the primary fuel nozzles 60. Fuel delivered through the primary nozzles 60 will swirl around the interior of the primary combustion zone to fully mix with the surrounding air, and as the air-fuel mixture moves into the secondary combustion zone 100 it would then be ignited. Thus, during steady state operations, it is desirable to deliver fuel through both the primary fuel nozzles 60, and the secondary fuel nozzle 70, and for all of the air and fuel to burn in the secondary combustion zone 100. More details of this fuel transition procedure will be described below after a description of a typical secondary fuel nozzle 70 has been provided.

Figure 2:
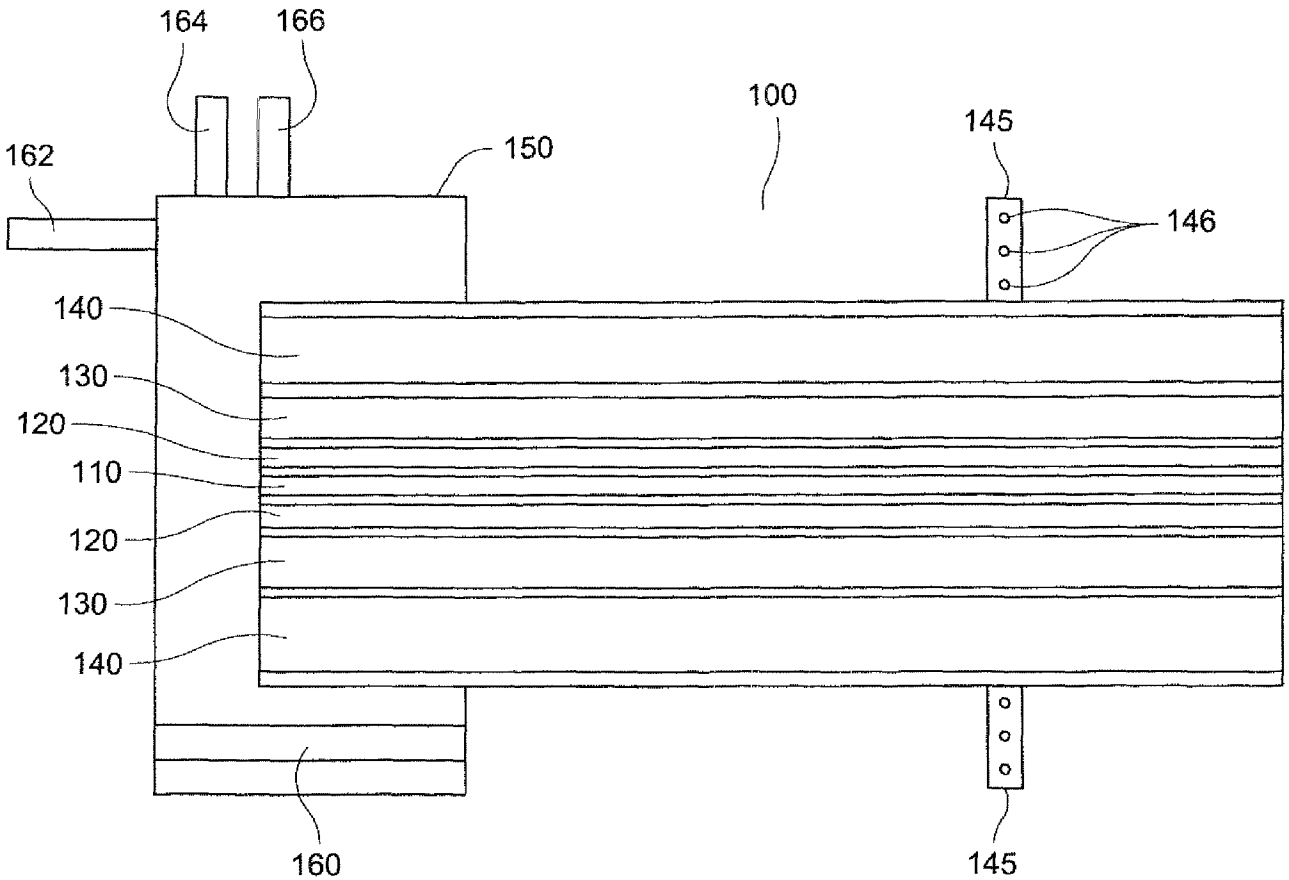
FIG. 2 is a cross-sectional view of a secondary fuel injection nozzle used in a combustor of a turbine engine.

FIG. 2 is a functional diagram of a typical secondary fuel nozzle 100. The secondary fuel nozzle includes multiple passageways which extend down the length of the housing of the nozzle. In the embodiment shown in FIG. 2, there is a central passageway 110 which can be used to deliver either fuel or air to the downstream end of the nozzle. A second passageway 120 concentrically surrounds the first passageway 110. There is also a third passageway 130 which concentrically surrounds the second passageway 120. Finally, there is a fourth passageway 140 which concentrically surrounds the third passageway 130. At least one of these passageways would deliver fuel to a plurality of radially extending fuel injectors 145. In some embodiments, the fourth passageway 140 might deliver fuel to the fuel injectors 145. In other embodiments, the third passageway 130 might deliver fuel to the fuel injectors 145, and the fourth passageway 140 might be used as a purge air passageway.

A plurality of fuel delivery apertures 146 are formed on the radially extending fuel injectors 145. As a result, fuel delivered to the fuel injectors exits through the fuel delivery apertures 146. During normal operations, compressed air is flowing down the length of the exterior of the fuel nozzle. Thus, the fuel exiting the fuel delivery apertures 146 mixes with the air passing down the length of the fuel nozzle to create an air-fuel mixture which can then be ignited. Although not shown, a variety of different swirler devices can be located upstream and/or downstream of the radially extending fuel injectors to increase the swirling and mixing action of the air, to thereby better mix the air with the fuel being delivered through the fuel delivery apertures 146.

Fuel being delivered through the fuel injectors 145 forms one fuel delivery mechanism of the fuel nozzle. However, fuel is also typically delivered through one or more of the internal passageways. For instance, fuel might be delivered through the second passageway 120. This fuel delivery circuit is often referred to as a pilot fuel circuit. The fuel being delivered through the second or pilot fuel passageway 120 exits the downstream end of the fuel nozzle and is also ignited. The flame produced by the fuel passing through the pilot or secondary passageway 120 is often referred to as a pilot flame. The pilot flame is quite stable and is not typically subjected to flame out.

The third passageway 130 typically carries purge air and/or fuel. The purge air being delivered through the third passageway 130 is used to cool the outer nozzle tip. In particular, the purge air cools the downstream end of the fuel nozzle, which is typically subjected to the highest temperatures due to the combustion zone located just downstream of the discharge end of the fuel nozzle. In addition, purge air is frequently delivered through the first passageway 110 located at the center of the fuel injection nozzle. Here again, the purge air passing through the first passageway 110 is designed to cool the nozzle, and in particular, the downstream end of the nozzle.

A header or manifold 150 is formed at the upstream end of the nozzle. The header 150 includes a variety of passageways which are designed to deliver fuel and air into the first, second, third and fourth passageways inside the fuel nozzle. The header 150 would typically be connected to a fuel delivery line 162 and to a purge air line 164. The purge air line 164 would be connected to a source of compressed air, which is typically tapped from the compressor section of the turbine. Thus, the line 164 delivering compressed air would typically run to a tap on the compressor section of the turbine or a compressor discharge plenum.

In addition, a transition fuel delivery line 166 is also connected to the manifold 150. The transition fuel delivery line 166 conveys fuel to the secondary fuel nozzle 100 which would otherwise be carried by and delivered from the primary fuel nozzles. Thus, during a fuel transition procedure as described above, when fuel is cut off from the primary fuel nozzles, that fuel would be delivered to the secondary fuel nozzle 100 through the transition fuel delivery line 166.

As explained above, when it is time to cease combustion in the primary combustion zone 90 of the combustor, the fuel to the primary fuel nozzles 60 is cut off, and the fuel that would otherwise be delivered through the primary fuel nozzles 60 is instead routed to the secondary fuel nozzle 70. As also explained above, that fuel must be delivered into the secondary combustion zone 100 through the secondary fuel nozzle 70.

Because one of the passageways is already delivering fuel through the radially extending fuel injectors 145, and because the pilot fuel passageway 120 is already delivering fuel through the secondary fuel nozzle, the only other portions of the secondary fuel nozzle which are available to deliver fuel into the secondary combustion zone are the passageways within the nozzle that are carrying purge air. Accordingly, during the fuel transition procedure, the fuel delivered to the secondary fuel nozzle via the transition fuel delivery line 166 is typically routed into purge air passageways. This means that the purge air normally carried through these passageways must be cut off, and fuel is instead delivered through these passageways. And during the time required to switch off the purge air and route fuel into the purge air passageways, no fuel or purge air is flowing through the purge air passageways.

As explained above, fuel would be delivered through the purge air passageways until combustion ceases in the primary combustion zone 90. During this period of time, fuel is passing through the purge air passageways, and the fuel acts to cool the downstream end of the secondary fuel nozzle. As a result, the temperature at the downstream end of the secondary fuel nozzle remains relatively low while fuel is running through the purge air passageways.

Once combustion ceases in the primary combustion zone 90, the fuel is transitioned back to the primary fuel nozzles, and purge air can again be delivered through the purge air passageways of the nozzle. However, the switch over procedure takes a certain amount of time. Typically, the fuel would be immediately switched back to the primary fuel nozzles 60. However, for a short period of time after that switch over, fuel will still reside in the purge air passageways of the nozzle.

When purge air is again introduced into the purge air passageways, the purge air will force the fuel remaining in these passageways out the downstream end of the nozzle. If the purge air were immediately switched on to its normal flow level, this would rapidly inject a large amount of fuel into the secondary combustion zone 110 at the same time that the primary fuel nozzles are also already delivering fuel, which would result in a surge in the combustion zone and possibly a resulting surge in the load output of the turbine. For these reasons, once fuel has been switched back to the primary fuel nozzles, the purge air is gradually and slowly introduced back into the purge air passageways so that any fuel in those passageways is gradually pushed out into the secondary combustion zone. And this further delays the time before purge air is flowing normally to cool the downstream end of the nozzle.

Figure 4:
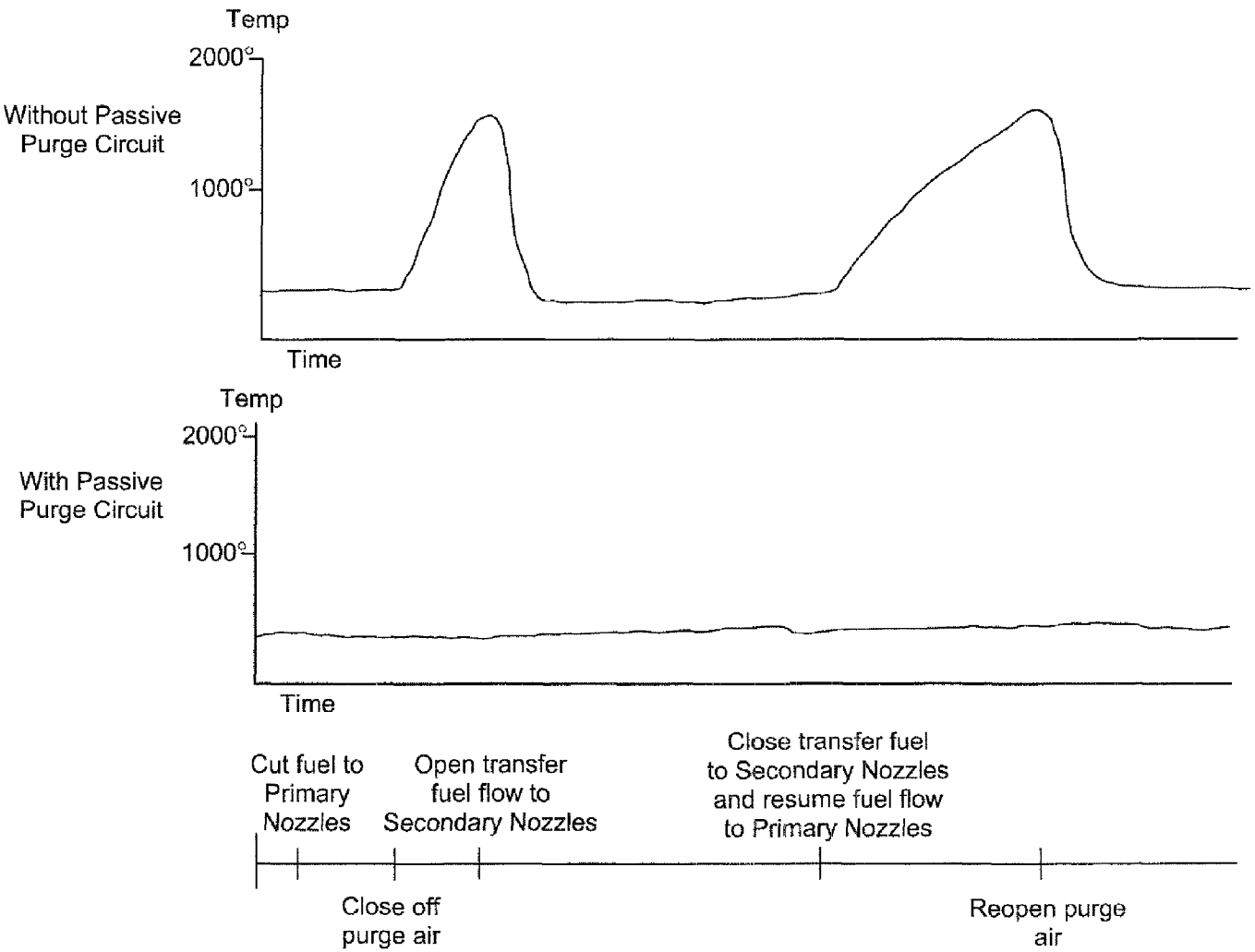
FIG. 4 is a diagram illustrating the temperatures which exist at a tip of two different fuel nozzles during a fuel transfer procedure.

As explained above, during a fuel transition procedure the temperature at the downstream end of the nozzle can raise to extremely high temperatures at two points in time. The upper half of FIG. 4 shows a diagram of the temperature of the tip of the nozzle during a typical fuel transition procedure. As shown in FIG. 4, fuel will be cut to the primary nozzles, and then the purge air to the secondary nozzle would be closed off. At that point in time, the temperature at the downstream tip of the fuel nozzle begins to rise quite rapidly. The temperature at the downstream end of the nozzle will continue to rise until fuel is running though the purge air passageways.

During normal steady state conditions, when purge air is being sent through the nozzle, the tip of the nozzle remains at approximately 300° F. Once the purge air is stopped, the temperature rapidly rises past 1000° F. Once the transfer fuel (which was previously being delivered into the combustor through the primary nozzles) begins to flow through the purge air passageways of the secondary nozzle, the temperature quickly returns to a temperature close to that of the fuel temperature.

During the time that fuel is being sent through the purge air passageways of the secondary nozzle, the temperature remains at relatively low, safe temperatures. However, once the transfer fuel supply is stopped and fuel is again delivered into the combustor through the primary nozzles, the temperature at the tip of the secondary nozzle again begins to rise. The temperature will continue to rise until purge air is gradually introduced into the purge air passageways, as explained above. Once the purge air is again flowing through the purge air passageways of the secondary nozzle, the temperature again returns back to normal.

As shown in the upper half of FIG. 4, the temperature at the tip of the secondary nozzle tends to peak at two different points in time during the fuel transfer procedure. The first peak occurs when the purge air has been closed off and no fuel is yet flowing through the purge air passageways of the secondary nozzle. The second peak occurs when the transfer fuel is shut off and before purge air is again flowing normally through the purge air passageways. During both these events, the temperature at the tip of the nozzle can rise as high as 1500° F. These temperatures are potentially quite damaging to the material of the nozzle tip and can lead to permanent damage.

Figure 3:
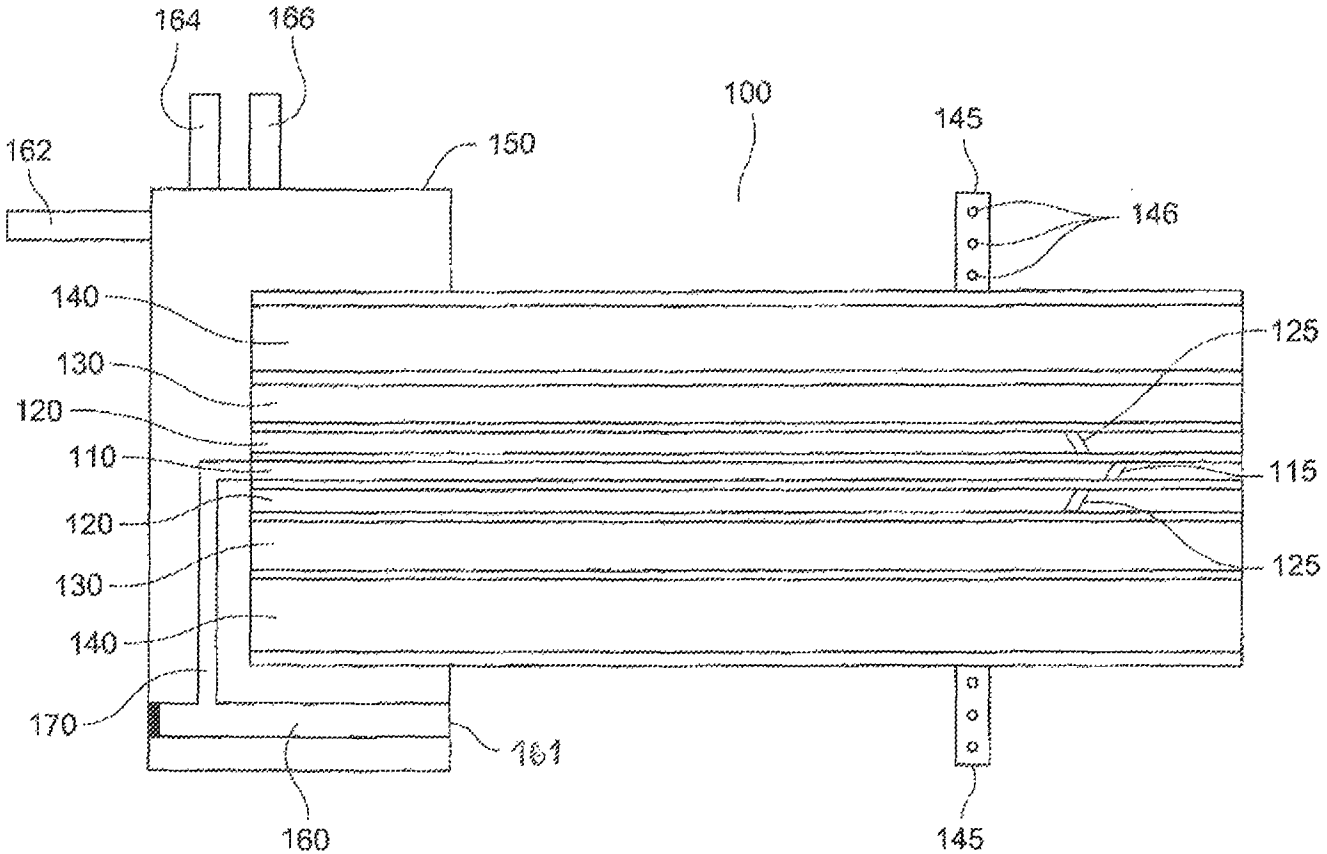
FIG. 3 is a cross-sectional view of another embodiment of a secondary fuel nozzle.

FIG. 3 shows a modified version of the secondary fuel nozzle. This embodiment is similar to the one shown in FIG. 2, however, the central purge air passageway 110 has been modified to communicate with an aperture formed on the exterior of the fuel nozzle at the upstream side of the nozzle. As shown in FIG. 3, a first passageway 170 is coupled to the inlet of the central purge air passageway 110. The first passageway 170 extends radially and is coupled to a second passageway 160 which leads to an aperture 161 on the header 150 of the nozzle. In addition, in this embodiment a swirler plate 115 is located at a downstream end of the central purge air passageway 110. Swirler plates 125 are also located in the pilot fuel passageway 120.

When a secondary fuel nozzle as illustrated in FIG. 3 is in operation inside a combustor, the pressure adjacent the downstream end of the nozzle will be lower than a pressure adjacent the upstream end of the nozzle. Because a swirler plate causes a pressure drop, the pressure differential between the upstream and downstream ends can be increased though the addition of a swirler plate 115 within the central purge air passageway 110. Because the pressure of the air at the upstream end of the fuel nozzle is higher than at the downstream end, during steady state operation of the nozzle, air will be drawn in through the aperture 161 and it will flow through the first and second passageways 170, 160 into the inlet of the purge air passageway 110, and then down the central purge air passageway 110. The flow will remain continuous so long as normal operations are occurring within the combustor.

When a nozzle as illustrated in FIG. 3 is used, during a fuel transition procedure as described above, the transition fuel supply line 166 will be coupled only to one or more of the second, third or fourth passageways. During the fuel transition procedure, purge air will continuously run through the central purge air passageway 110. This continuous supply of purge air ensures that the temperature of the tip of the nozzle at the downstream end will remain relatively constant, even during the fuel transition procedure. In addition, because the flow of the purge air through the central purge air passageway 110 is generated due to a pressure differential between the air surrounding the downstream end of the nozzle and the air at the upstream end of the nozzle, there is no need to provide a separate supply of compressed purge air from a compressor section of the turbine. Instead, the purge air running though the central purge air passageway 110 is simply drawn from the compressed air already surrounding the upstream end of the nozzle.

In the embodiment illustrated in FIG. 3, the secondary flame detector sight hole of the nozzle is used as the second passageway 160 for delivering air to the central purge air passageway 110. As a result, it is only necessary to modify the first embodiment shown in FIG. 2 through the addition of the radially extending first passageway 170 that connects the secondary flame detector sight hole and the inlet to the central purge air passageway 110. Thus, a very simple modification to the original secondary nozzle can insure that purge air is always supplied, even during a fuel transition procedure.

In addition, in the embodiment shown in FIG. 3, the central purge air passageway 110 is coupled to the passageway 170 leading out to a position outside the upstream end of the nozzle. In alternate embodiments, different passageways other than the central passageway 110 might be connected to the passageway 170. In still other embodiments, the passageway 170 might be connected to multiple ones of the passageways inside the nozzle.

The lower portion of FIG. 4 illustrates the temperature at the downstream end of a nozzle as shown in FIG. 3 during a fuel transition procedure. As shown therein, the temperature of the downstream tip of the fuel nozzle remains relatively constant, even during the fuel transition procedure. This prevents the downstream end of the nozzle from being damaged by high temperatures during the fuel transition procedure.

In the foregoing description, the embodiments shown in FIGS. 2 and 3 were used as an example of how a passive purge air circuit could be provided on a secondary fuel nozzle to ensure a constant supply of purge air, even during a fuel transition procedure. The embodiments shown in FIGS. 2 and 3 illustrate a secondary nozzle having two purge air passageways, a pilot fuel passageway, and a main fuel passageway. In alternate embodiments, the passageways could be configured in different orientations and the pilot fuel passageway could be eliminated. In addition, one fuel delivery passageway could deliver fuel to the radially extending fuel injectors, and the same or a different fuel delivery passageways could also deliver fuel through apertures located at the downstream end of the nozzle. The configurations shown in FIGS. 2 and 3 are only intended to be illustrative, and not limiting. A secondary fuel nozzle could be configured in a variety of different ways depending on the requirements of a particular turbine.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel nozzle for a turbine engine, comprising:

an elongated housing having a central longitudinal axis;

at least one fuel delivery passageway that extends down at least a portion of the housing;

an active purge air passageway that extends down the housing and that delivers purge air to at least one active purge air discharge opening that is located at the discharge end of the nozzle; and a passive purge air passageway having an inlet that admits air from a position outside the nozzle and adjacent an upstream end of the housing, and having an outlet that is located at the discharge end of the nozzle, wherein the inlet of the passive purge air passageway comprises:

a first transfer passageway that extends radially through the nozzle from an upstream end of the passive purge air passageway; and a second transfer passageway that extends from an outward end of the first transfer passageway toward the discharge end of the nozzle in a direction that is substantially parallel to the central longitudinal axis of the housing such that air traveling through the second transfer passageway and into the passive purge air passageway travels in an upstream direction.

2. The fuel nozzle of claim 1, wherein when the fuel nozzle is in use in an operational turbine engine, a pressure differential between air outside the nozzle and adjacent the upstream end of the housing and air located at the outlet of the passive purge air passageway causes purge air to flow along the passive purge air passageway from the inlet to the outlet.

3. The fuel nozzle of claim 1, further comprising a plurality of fuel injectors located on an exterior of the housing, wherein the inlet of the passive purge air passageway is located on the housing at a position that is upstream of the fuel injectors.

4. The fuel nozzle of claim 1, wherein the second transfer passageway comprises a portion of a secondary flame detector sight hole located on the housing.

5. The fuel nozzle of claim 1, further comprising a swirler plate located in the passive purge air passageway.

6. A fuel nozzle for a turbine engine, comprising:

an elongated housing having a central longitudinal axis;

a fuel delivery passageway that extends along at least a portion of the housing;

an active purge air passageway that extends along the housing and that delivers purge air to at least one active purge air discharge opening that is located at a downstream end of the nozzle; and a passive purge air passageway having an inlet that admits air from a position outside the nozzle and adjacent an upstream end of the housing, and having an outlet that is located at the downstream end of the nozzle, wherein when the fuel nozzle is in use in an operational turbine engine, a pressure differential between air outside the nozzle and adjacent the upstream end of the housing and air located at the outlet of the passive purge air passageway causes purge air to flow along the passive purge air passageway from the inlet to the outlet, wherein the passive purge air passageway comprises:

a first section that extends from the inlet in a direction substantially parallel to the longitudinal axis, wherein air flowing through the first section of the passive purge air passageway is flowing in an upstream direction;

a second section that extends inward in a radial direction from an upstream end of the first section; and a third section that extends in a direction substantially parallel to the longitudinal axis from the inward end of the second section to the outlet at the downstream end of the nozzle.

7. The fuel nozzle of claim 6, wherein the first section of the passive purge air passageway comprises a portion of a secondary flame detector sight hole located on the housing.

8. The fuel nozzle of claim 6, further comprising a pilot fuel passageway that extends down the housing and that delivers fuel to at least one pilot fuel discharge opening located at the downstream end of the nozzle near a central longitudinal axis of the housing.

9. The fuel nozzle of claim 8, further comprising a fuel supply inlet on the housing, wherein the fuel delivery passageway and the pilot fuel passageway are both coupled to the fuel supply inlet.

10. The fuel nozzle of claim 8, further comprising an active purge air inlet on the housing, wherein the active purge air passageway is coupled to the active purge air inlet.

11. The fuel nozzle of claim 6, wherein air flowing through the passive purge air passageway flows through the first section, then through the second section, and then through the third section.

* * * * *

UNITED STATES PATENT AND TRADEMARK OFFICE

CERTIFICATE OF CORRECTION

PATENT NO. : 8,522,554 B2
APPLICATION NO. : 12/652244
DATED : September 3, 2013
INVENTOR(S) : Intile et al.

It is certified that error appears in the above-identified patent and that said Letters Patent is hereby corrected as shown below:

In the Specification

At column 2, line 23, insert --40-- between "between the combustor liner" and "and the flow sleeve 30 to the"

Signed and Sealed this
Fifteenth Day of October, 2013

Teresa Stanek Rea
*Deputy Director of the United States Patent and Trademark Office*